US010739732B2

(12) United States Patent
Tasaka

(10) Patent No.: US 10,739,732 B2
(45) Date of Patent: Aug. 11, 2020

(54) ANTENNA DEVICE AND TIMEPIECE

(71) Applicant: CASIO COMPUTER CO., LTD., Tokyo (JP)

(72) Inventor: Hideo Tasaka, Ome (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 34 days.

(21) Appl. No.: 16/175,944

(22) Filed: Oct. 31, 2018

(65) Prior Publication Data

US 2019/0129364 A1 May 2, 2019

(30) Foreign Application Priority Data

Nov. 2, 2017 (JP) ..... 2017-212388

(51) Int. Cl.

| | |
|---|---|
| ***H01Q 1/27*** | (2006.01) |
| ***G04R 60/10*** | (2013.01) |
| ***G04R 60/12*** | (2013.01) |
| ***H01Q 9/04*** | (2006.01) |
| ***G04R 20/04*** | (2013.01) |

(Continued)

(52) U.S. Cl.

CPC ..... *G04R 60/10* (2013.01); *G04G 17/04* (2013.01); *G04G 21/04* (2013.01); *G04R 20/04* (2013.01); *H01Q 1/243* (2013.01); *H01Q 1/273* (2013.01); *H01Q 1/38* (2013.01); *H01Q 1/44* (2013.01); *H01Q 7/00* (2013.01); *H01Q 9/0421* (2013.01); *H01Q 9/0442* (2013.01)

(58) Field of Classification Search

CPC ..... G04G 17/04; G04G 21/04; G04R 20/04; G04R 60/10; G04R 60/12; H01Q 1/24; H01Q 1/243; H01Q 1/27; H01Q 1/273; H01Q 1/38; H01Q 1/44; H01Q 7/00; H01Q 9/04; H01Q 9/0421; H01Q 9/0442

See application file for complete search history.

(56) References Cited

U.S. PATENT DOCUMENTS

| | | | | |
|---|---|---|---|---|
| 6,380,900 | B1 * | 4/2002 | Kanayama | H01Q 1/243 343/702 |
| 6,512,491 | B2 * | 1/2003 | Kanayama | H01Q 1/243 343/702 |

(Continued)

FOREIGN PATENT DOCUMENTS

| | | |
|---|---|---|
| CN | 101957590 A | 1/2011 |
| CN | 106711585 A | 5/2017 |

(Continued)

OTHER PUBLICATIONS

First Office Action dated Apr. 22, 20202 received in Chinese Patent Application No. CN 2018112942331 together with an English language translation.

*Primary Examiner* — Tho G Phan

(74) *Attorney, Agent, or Firm* — Scully Scott Murphy & Presser

(57) ABSTRACT

An antenna device including an antenna which is made of metal and receives radio wave, a substrate on which a first electrode and a second electrode are arranged such that one of the first electrode and the second electrode is plurally arranged, and are positioned on circumference of a circle centering on center of the antenna, and a connection section which connects a connection target first electrode to the antenna and connects a connection target second electrode to the antenna.

20 Claims, 8 Drawing Sheets

(51) Int. Cl.

| | |
|---|---|
| ***H01Q 1/24*** | (2006.01) |
| ***H01Q 7/00*** | (2006.01) |
| ***G04G 21/04*** | (2013.01) |
| ***H01Q 1/44*** | (2006.01) |
| ***H01Q 1/38*** | (2006.01) |
| ***G04G 17/04*** | (2006.01) |

(56) References Cited

U.S. PATENT DOCUMENTS

| | | | | |
|---|---|---|---|---|
| 7,446,709 | B2 | 11/2008 | Ishimiya | |
| 8,456,959 | B2 | 6/2013 | Fujisawa | |
| 8,665,675 | B2 | 3/2014 | Fujisawa | |
| 8,995,236 | B2 | 3/2015 | Fujisawa | |
| 9,219,304 | B2 * | 12/2015 | Nagahama | H01Q 1/44 |
| 9,377,763 | B2 * | 6/2016 | Fujisawa | G04R 60/06 |
| 2002/0095588 | A1 * | 7/2002 | Shigematsu | G07C 9/23 713/186 |
| 2006/0176223 | A1 | 8/2006 | Ishimiya | |
| 2011/0013491 | A1 | 1/2011 | Fujisawa | |
| 2013/0242711 | A1 | 9/2013 | Fujisawa | |
| 2014/0086020 | A1 | 3/2014 | Fujisawa | |
| 2014/0126337 | A1 | 5/2014 | Fujisawa | |
| 2017/0031326 | A1 * | 2/2017 | Omote | G04B 37/1486 |

FOREIGN PATENT DOCUMENTS

| | | | |
|---|---|---|---|
| JP | 2006-217389 | A | 8/2006 |
| JP | 2014-062845 | A | 4/2014 |
| JP | 2014-130159 | A | 7/2014 |

* cited by examiner

ANTENNA DEVICE AND TIMEPIECE

CROSS-REFERENCE TO RELATED APPLICATION

This application is based upon and claims the benefit of priority from the prior Japanese Patent Application No. 2017-212388, filed Nov. 2, 2017, the entire contents of which are incorporated herein by reference.

BACKGROUND

1. Field of the Invention

The present invention relates to an antenna device for use in an electronic device such as a wristwatch, and a timepiece equipped with the antenna device.

2. Description of the Related Art

For example, a wristwatch is known which has a GPS (Global Positioning System) antenna, as described in Japanese Patent Application Laid-Open (Kokai) Publication No. 2014-130159. This type of wristwatch has a structure where a ring-shaped exterior member is provided on an upper portion of a cylindrical case body, a ring-shaped antenna is provided on the inner circumference of the exterior member and arranged on a metal support board of a dial plate for ground connection, and the feeding point of the antenna is connected in this state to a circuit board by a contact pin.

In the case of this wristwatch, when the sizes of the outer shapes of the case body and the exterior member are changed, the size of the antenna is also changed along with it. Accordingly, in this wristwatch, in order to secure the reception performance of the antenna, the position of the feeding point and the arrangement position of the contact pin are required to be changed in accordance with the size of the antenna. Thus, in this wristwatch, every time the position of the feeding point and the arrangement position of the contact pin are changed in accordance with the size of the antenna, the designs of the metal support board, the circuit board, and the like are required to be changed in accordance with the position of the feeding point and the arrangement position of the contact pin.

SUMMARY

In accordance with one embodiment, there is provided an antenna device comprising: an antenna which is made of metal and receives radio wave; a substrate on which a first electrode and a second electrode are arranged such that one of the first electrode and the second electrode is plurally arranged, and are positioned on circumference of a circle centering on center of the antenna; and a connection section which connects a connection target first electrode to the antenna and connects a connection target second electrode to the antenna.

The above and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENTS

An embodiment applied in a wristwatch will hereinafter be described with reference to FIG. 1 to FIG. 8B.

Figure 1:
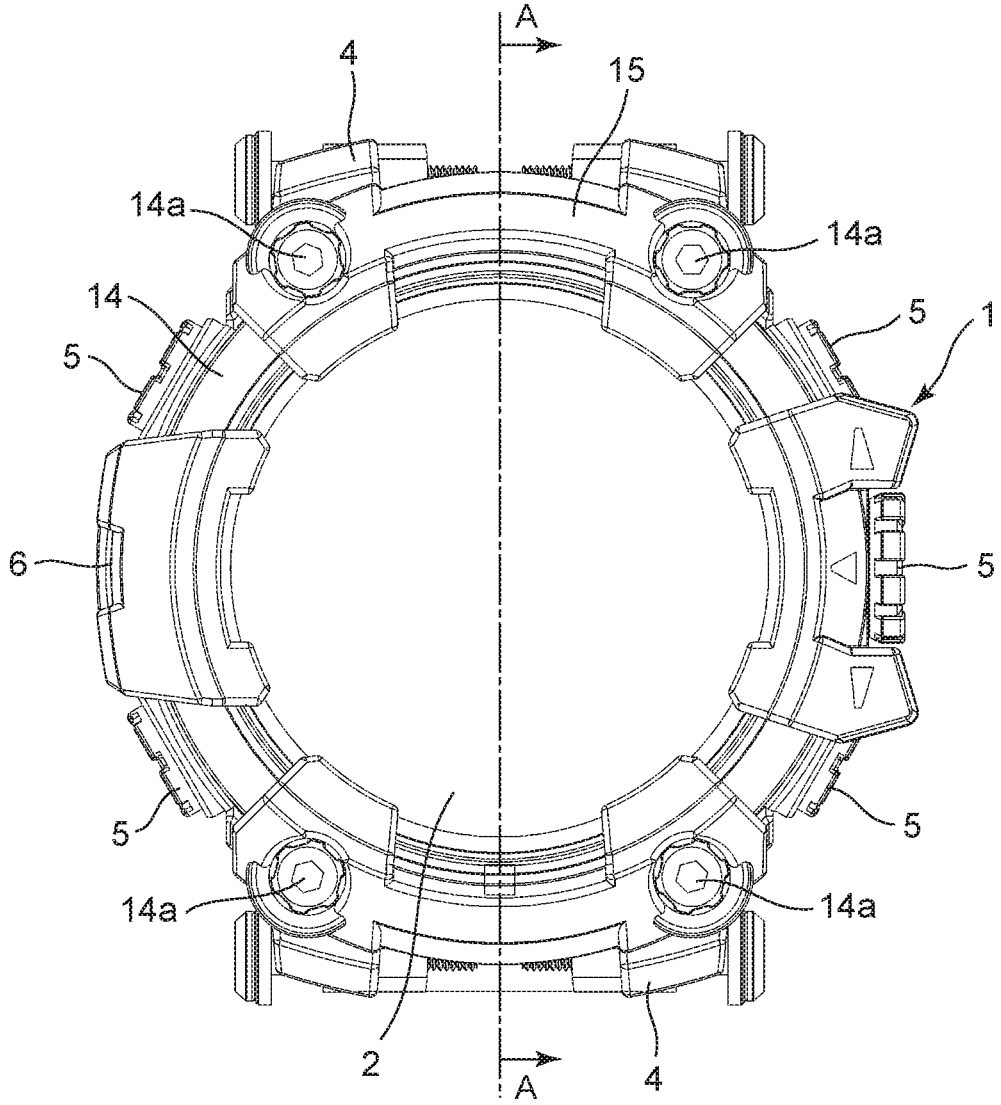
FIG. 1 is an enlarged front view showing an embodiment where the present invention has been applied in a wristwatch.
Figure 2:
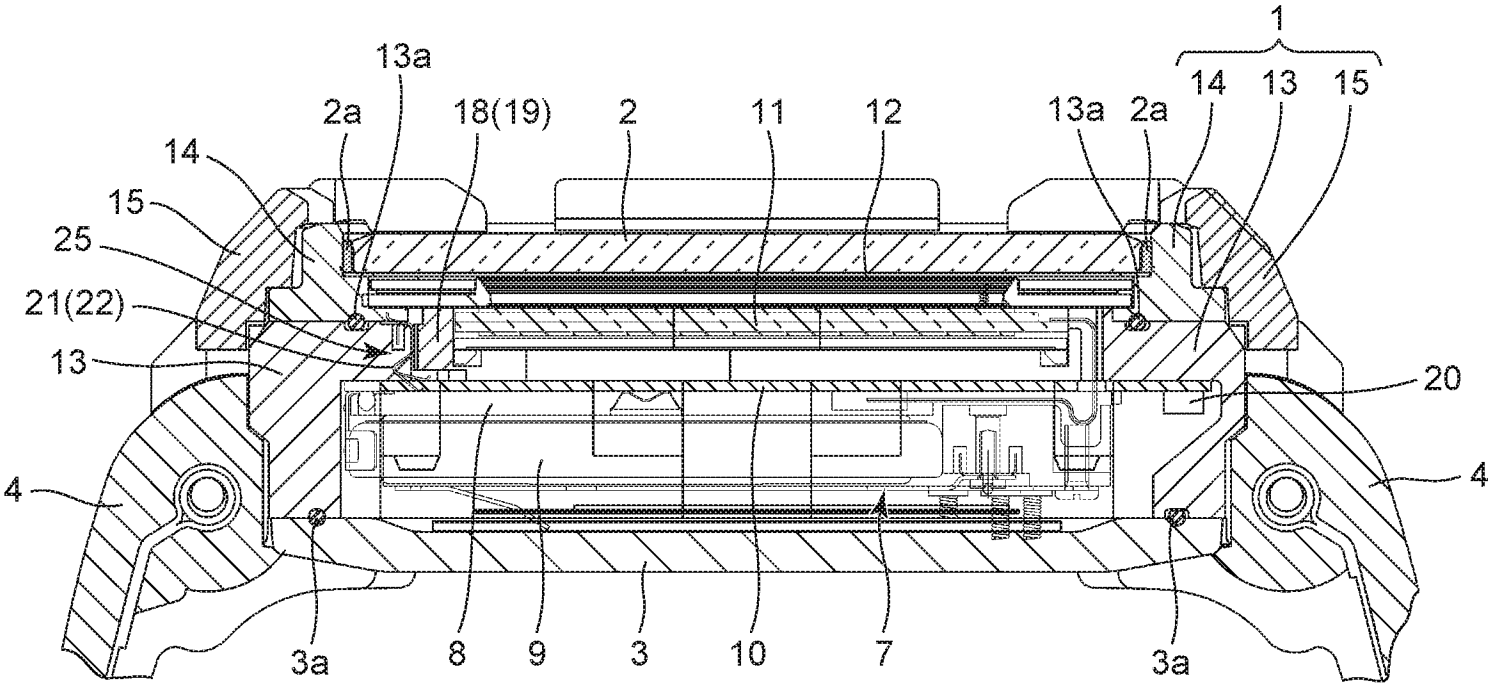
FIG. 2 is an enlarged cross-sectional view of the wristwatch taken along line A-A shown in FIG. 1.

This wristwatch includes a wristwatch case 1, as shown in FIG. 1 and FIG. 2. This wristwatch case 1 has a watch glass 2 mounted in its upper opening portion via a glass packing 2*a*, and a rear lid 3 attached to its lower portion via a waterproof packing 3*a*.

On side portions of the wristwatch case 1 on the 12 o'clock side and the 6 o'clock side, band attachment sections 4 to which a wristwatch band (not shown) is attached are respectively provided. Also, on side portions of the wristwatch case 1 on the 2 o'clock side, the 3 o'clock side, the 4 o'clock side, and the 8 o'clock side, switch buttons 5 are respectively provided. On a side portion of the wristwatch case 1 on the 9 o'clock side, a sensor section 6 such as a pressure sensor and a temperature sensor is provided which detects the external environment of the wristwatch case 1.

In the wristwatch case 1, a timepiece module 7 is provided, as shown in FIG. 2. This timepiece module 7 has a housing 8, in which a battery 9 is housed. On an upper portion of the housing 8, a circuit board 10 is arranged. On this circuit board 10, a display panel 11 is supported with it being electrically connected by an interconnector (not shown).

The display panel 11 is a flat type display panel such as a liquid crystal display panel or an EL (Electro Luminescence) display panel, and structured to electrooptically display various information required for a clock function, such as clock time, as shown in FIG. 2. In an area above this display panel 11, a dial plate unit 12 is arranged. This dial plate unit 12 is constituted by a solar panel being arranged between a pair of transparent dial plates, that is, a top dial plate and a bottom dial plate, and the wristwatch is structured such that information displayed by the display panel 11 can be viewed via this dial plate unit 12.

The wristwatch case 1 includes a case main body 13 made of hard synthetic resin, a metal antenna 14 that receives radio waves, an exterior member 15 made of soft synthetic resin, as shown in FIG. 2. The case main body 13 is formed having a substantially circular ring shape. Inside this case main body 13, the timepiece module 7 is provided, and the dial plate unit 12 is not provided therein. The exterior member 15 is formed of soft synthetic resin such as urethane resin, and is attached to outer circumference portions of the case main body 13 and the antenna 14.

Figure 3:
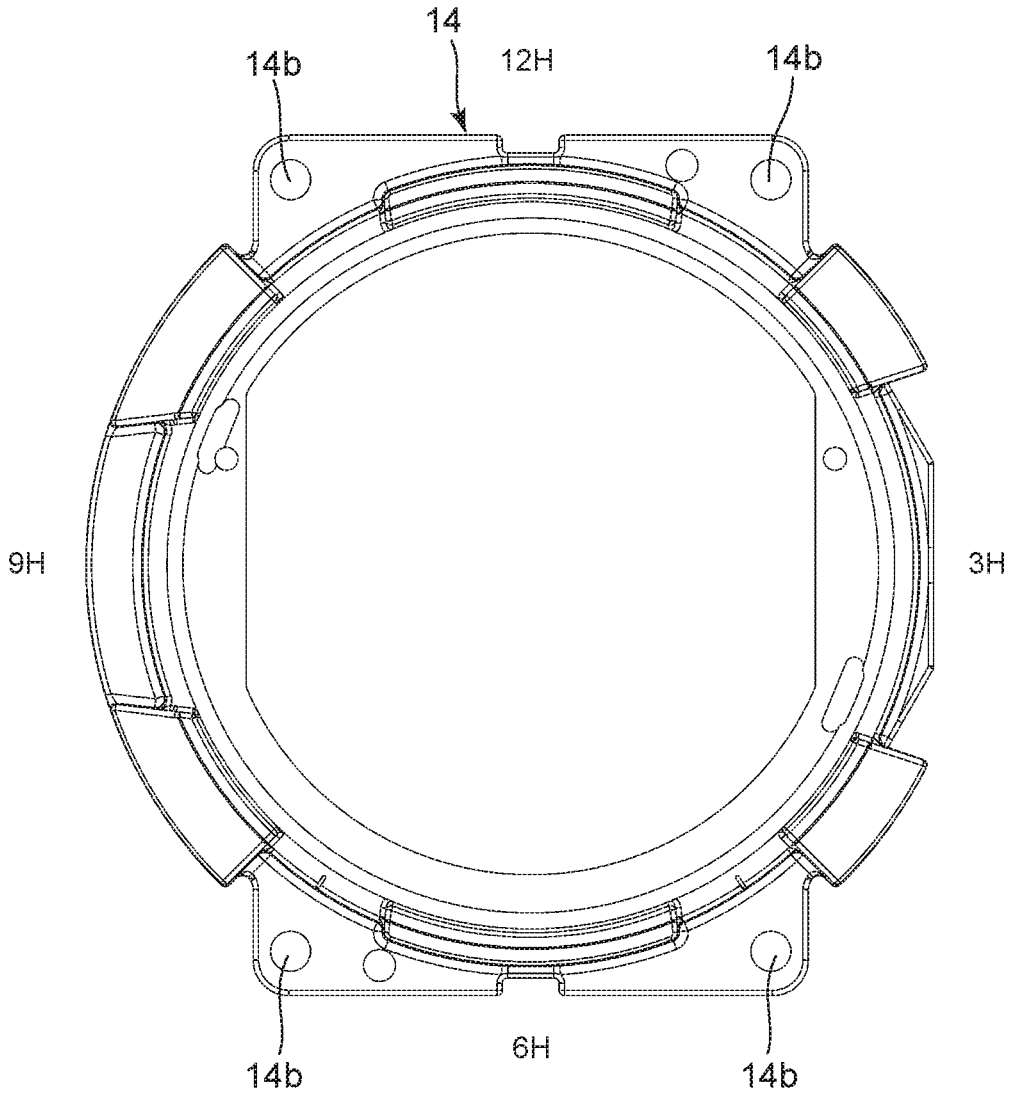
FIG. 3 is an enlarged front view showing an antenna of the wristwatch shown in FIG. 2.

The antenna 14, which is a GPS antenna for receiving radio waves of high frequency (for example, 1575.42 MHz), is formed in a ring shape substantially the same as that of the case main body 13, and functions as a bezel of the wristwatch, as shown in FIG. 1 to FIG. 3. This antenna 14 is attached to an upper portion of the case main body 13 by a plurality of screws 4*a* via a waterproof ring 13*a*. In the inner area of this antenna 14, the watch glass 2 is attached via the glass packing 2*a*, and the dial plate unit 12 is arranged.

Figure 4:
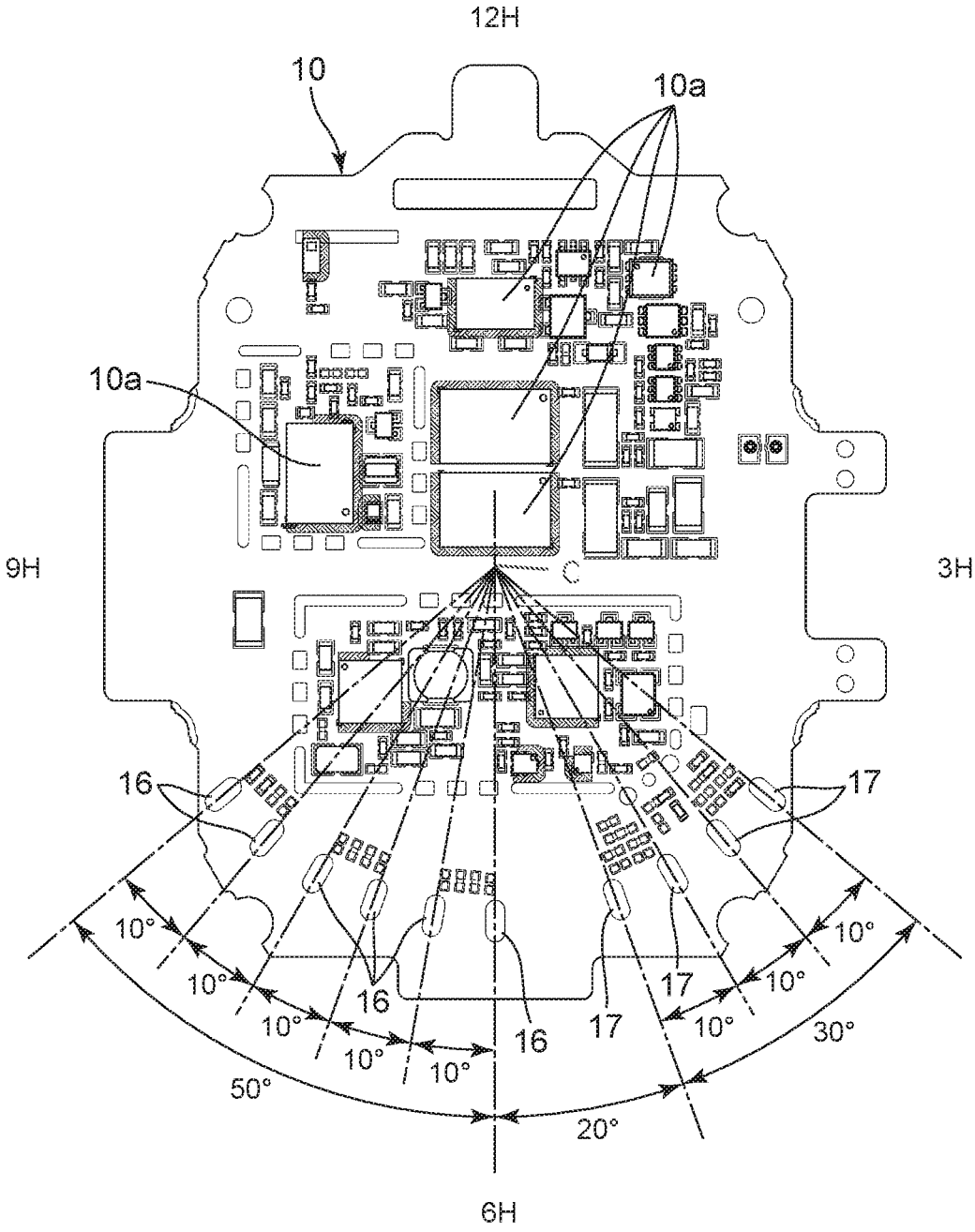
FIG. 4 is an enlarged front view showing a circuit board of the wristwatch shown in FIG. 2.
Figure 5:
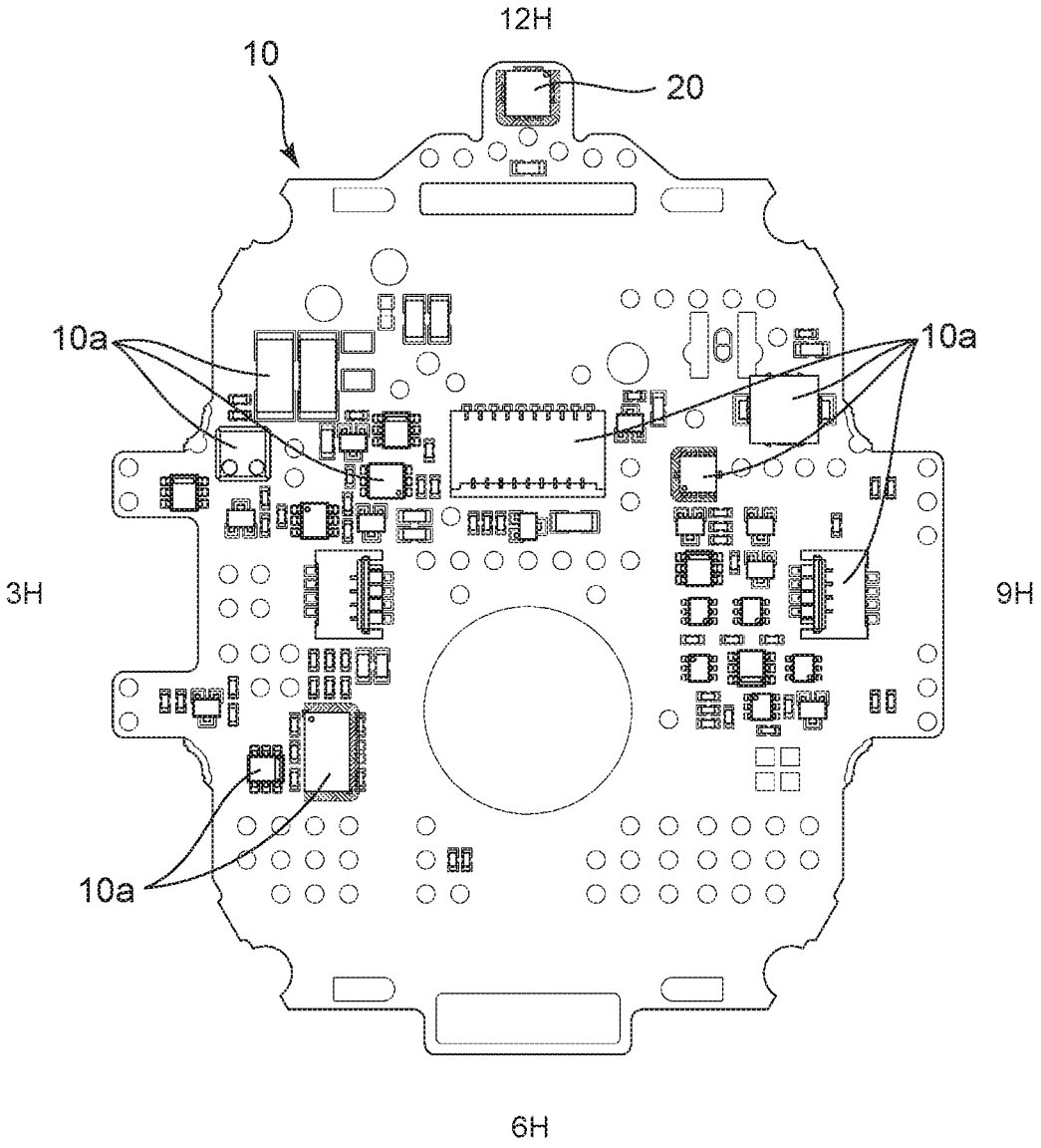
FIG. 5 is an enlarged rear view showing the circuit board shown in FIG. 4.
Figure 7:
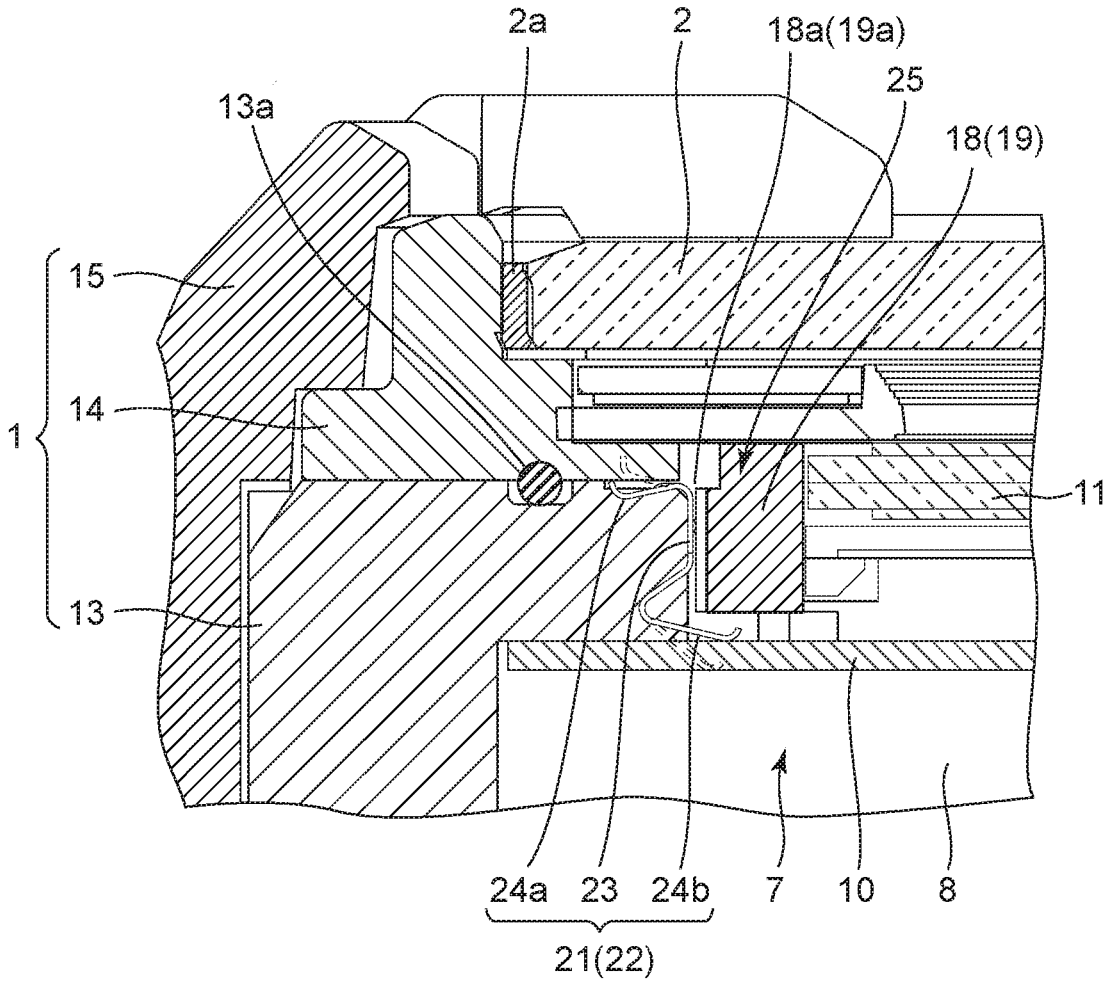
FIG. 7 is an enlarged cross-sectional view showing an important portion of the wristwatch shown in FIG. 2.

This antenna 14 is structured to be electrically connected to the circuit board 10 on the timepiece module 7 by a connection section 25 described later, as shown in FIG. 2 and FIG. 7. On the front and rear surfaces of the circuit board 10, various types of electronic components 10*a* are mounted, as shown in FIG. 4 and FIG. 5. On the front surface (the upper surface in FIG. 2), a plurality of first electrodes 16 and a plurality of second electrodes 17 are provided. On the 12 o'clock side of the rear surface (the undersurface in FIG. 2), a magnetic sensor 20 is provided.

The plurality of first electrodes 16 is ground electrodes, as shown in FIG. 4. Also, the plurality of second electrodes 17 is feeding electrodes. The plurality of first electrodes 16 and the plurality of second electrodes 17 are arranged on peripheral portions of the circuit board 10 on the 6 o'clock side in a manner that they are positioned on the circumference of a circle centering on the center of the circuit board 10 corresponding to the center C of the antenna 14.

More specifically, the first electrodes 16 are arranged at equal intervals in an area between the 6 o'clock side and the 8 o'clock side, as shown in FIG. 4. Here, as an example, six electrodes are arranged as the first electrodes 16, and one of them is electrically connected to the antenna 14 by the connection section 25. In this embodiment, these six first electrodes 16 are arranged at intervals each having a central angle of 10 degrees, toward the 8 o'clock side from a reference line that is a straight line extending in the 6 o'clock direction from the center of the circuit board 10 corresponding to the center of the antenna 14. That is, the plurality of first electrodes 16 are provided within a range corresponding to a central angle of 0 to 50 degrees from the reference line extending in the 6 o'clock direction from the center of the circuit board 10.

Also, the second electrodes 17 are arranged at equal intervals in an area between the 6 o'clock side and the 4 o'clock side, as shown in FIG. 4. Here, as an example, four electrodes are arranged as the second electrodes 17, and one of them is electrically connected to the antenna 14 by the connection section 25. In this embodiment, these four second electrodes 17 are arranged at intervals each having a central angle of 10 degrees, toward the 4 o'clock side from a point that is distant by a length corresponding to a central angle of 0 to 20 degrees from the reference line that is a straight line extending in the 6 o'clock direction from the center of the circuit board 10. That is, the plurality of second electrodes 17 are provided within a range corresponding to a central angle of 0 to 30 degrees from the point that is distant by the length corresponding to a central angle of 0 to 20 degrees from the reference line extending in the 6 o'clock direction from the center of the circuit board 10.

The magnetic sensor 20, which detects an azimuth, is provided at a position on the 12 o'clock side which is a position opposing the plurality of first electrodes 16 and the plurality of second electrodes 17, or in other words, a position where it is farthest from the plurality of first electrodes 16 and the plurality of second electrodes 17, as shown in FIG. 4 and FIG. 5. As a result, their effects on the accuracy and performance of the magnetic sensor 20 can be minimized. In addition, the magnetic sensor 20 does not have any effect on them.

The connection section 25 is structured such that one of the plurality of first electrodes 16 is selectively connected to the antenna 14 and one of the plurality of second electrodes 17 is selectively connected to the antenna 14. As a result of this structure, a distance between a first electrode 16 to be connected to the antenna 14 and a second electrode 17 to be connected to the antenna 14 can be changed, as shown in FIG. 6 and FIG. 7.

Figure 6:
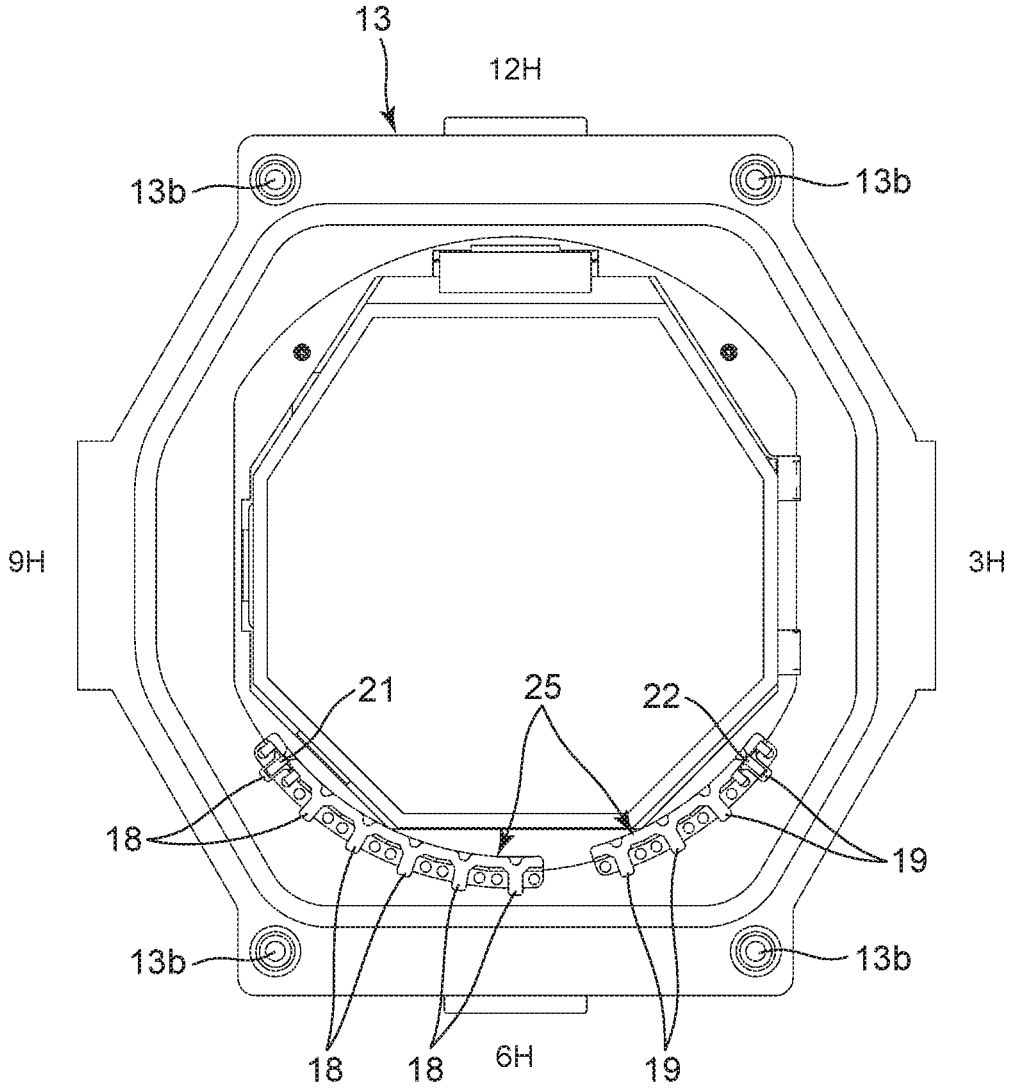
FIG. 6 is an enlarged front view showing a case body of the wristwatch shown in FIG. 2.

More specifically, the connection section 25 includes a plurality of first attachment sections 18 corresponding to the plurality of first electrodes 16, a first connection piece 21 that is selectively attached to one of the plurality of first attachment sections 18 so that the corresponding first electrode 16 and the antenna 14 are connected to each other, a plurality of second attachment sections 19 corresponding to the plurality of second electrodes 17, a second connection piece 22 that is selectively attached to one of the plurality of second attachment sections 19 so that the corresponding second electrode 17 and the antenna 14 are connected to each other, as shown in FIG. 6 and FIG. 7.

The plurality of first attachment sections 18 are provided on the inner circumference surface of the case main body 13 with them corresponding to the plurality of first electrodes 16 provided on the circuit board 10, as shown in FIG. 6. Also, the plurality of second attachment sections 19 are provided on the inner circumference surface of the case main body 13 with them corresponding to the plurality of second electrodes 17 provided on the circuit board 10.

Figure 8A:
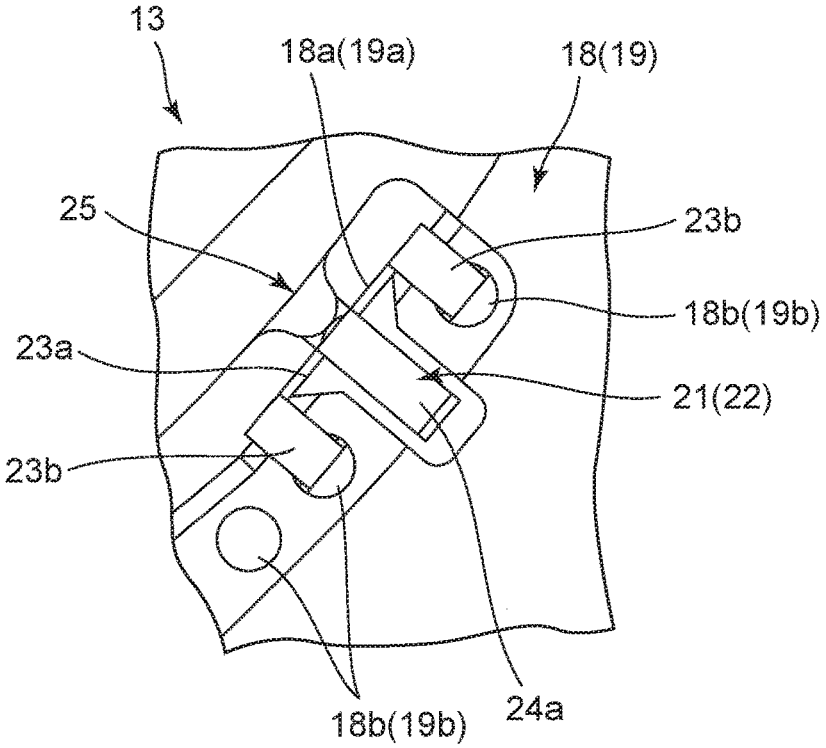
FIG. 8A is an enlarged front view showing a first (second) connection piece of the antenna device shown in FIG. 7, in which the first (second) connection piece has been attached to a first (second) attachment section of the case body.

Each of the plurality of first attachment sections 18 is a hole section where the first connection piece 21 is selectively attached, and includes a slit hole 18*a* and a pair of locking holes 18*b*, as shown in FIG. 7 and FIG. 8A. Also, each of the plurality of second attachment sections 19 is a hole section where the second connection piece 22 is selectively attached, and includes a slit hole 19*a* and a pair of locking holes 19*b*, as with each of the first attachment sections 18.

Figure 8B:
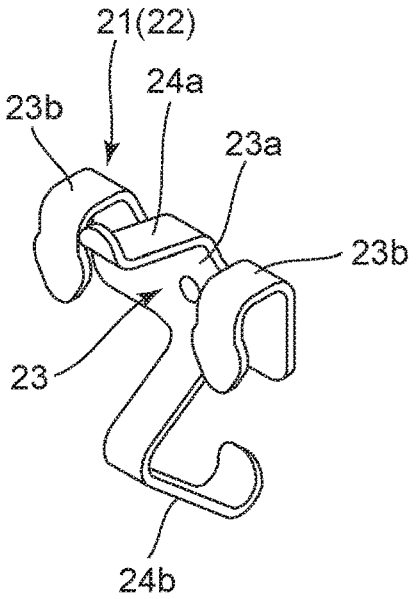
FIG. 8B is an enlarged perspective view showing the first (second) connection piece of the antenna device shown in FIG. 7.

The second connection piece 22 is the same as the first connection piece 21, as shown in FIG. 8A and FIG. 8B. More specifically, the first connection piece 21 includes a fixing section 23 which is fixed in one of the plurality of first attachment sections 18, a first plate spring section 24*a* which resiliently comes in contact with the antenna 14, and a second plate spring section 24*b* which resiliently comes in contact with one of the plurality of first electrodes 16.

As with this first connection piece 21, the second connection piece 22 includes a fixing section 23 which is fixed in one of the plurality of second attachment sections 19, a first plate spring section 24*a* which resiliently comes in contact with the antenna 14, and a second plate spring section 24*b* which resiliently comes in contact with one of the plurality of second electrodes 17, as shown in FIG. 8A and FIG. 8B.

Each fixing section 23 includes a main body section 23*a* which is inserted into the slit hole 18*a* of one of the first attachment sections 18 or the slit hole 19*a* of one of the second attachment sections 19, and a pair of hook sections 23*b* which is held in the pair of locking holes 18*b* provided to the sides of the slit hole 18*a* of each first attachment section 18 or the pair of locking holes 19*b* provided to the sides of the slit hole 19*a* of each second attachment section 19, as shown in FIG. 8A and FIG. 8B.

As a result, the first connection piece 21 is structured such that the main body section 23*a* of the fixing section 23 is inserted into the slit hole 18*a* in one of the plurality of first attachment sections 18, and the pair of hook sections 23*b* is held in the pair of locking holes 18*b* in one of the plurality of first attachment sections 18, whereby the first connection piece 21 is fixed to the case main body 13, as shown in FIG. 7 and FIG. 8A.

Also, this first connection piece 21 is structured such that, when the fixing section 23 is attached to one of the plurality of first attachment sections 18, the first plate spring section 24*a* resiliently comes in contact with the undersurface of the antenna 14, and the second plate spring section 24*b* resiliently comes in contact with one of the plurality of first electrodes 16 on the circuit board 10, whereby the antenna 14 and the circuit board 10 are electrically connected to each other, as shown in FIG. 7 and FIG. 8A.

On the other hand, the second connection piece 22 is structured such that the main body section 23*a* of the fixing section 23 is inserted into the slit hole 19*a* in one of the plurality of second attachment sections 19, and the pair of hook sections 23*b* is held in the pair of locking holes 19*b* in one of the plurality of second attachment sections 19, whereby the second connection piece 22 is fixed to the case main body 13, as shown in FIG. 7 and FIG. 8A.

Also, this second connection piece 22 is structured such that, when the fixing section 23 is attached to one of the plurality of second attachment sections 19, the first plate spring section 24*a* resiliently comes in contact with the undersurface of the antenna 14, and the second plate spring section 24*b* resiliently comes in contact with one of the plurality of second electrodes 17 on the circuit board 10, whereby the antenna 14 and the circuit board 10 are electrically connected to each other, as shown in FIG. 7 and FIG. 8A.

Accordingly, this antenna device is constituted by the antenna 14, the plurality of first electrodes 16 and the plurality of second electrodes 17 provided on the circuit board 10, and the first connection piece 21 and the second connection piece 22 of the connection section 25. In this antenna device, the reception frequency of the antenna 14 is changed in accordance with a distance between one of the first electrodes 16 selectively connected to the antenna 14 by the first connection piece 21 and one of the second electrodes 17 selectively connected to the antenna 14 by the second connection piece 22.

This distance between one of the first electrodes 16 to be selectively connected by the first connection piece 21 and one of the second electrodes 17 to be selectively connected by the second connection piece 22 corresponds to a central angle (hereinafter referred to as "spacing angle") formed by their positions and the center of the circuit board 10 corresponding to the center of the antenna 14, as shown in FIG. 4.

That is, in this antenna device, when a distance (spacing angle) between one of the first electrodes 16 selectively connected by the first connection piece 21 and one of the second electrodes 17 selectively connected by the second connection piece 22 is large, the reception frequency of the antenna 14 is high. Conversely, when a distance (spacing angle) between one of the first electrodes 16 selectively connected by the first connection piece 21 and one of the second electrodes 17 selectively connected by the second connection piece 22 is small, the reception frequency of the antenna 14 is low.

As a result, this antenna device is structured such that, by the adjustment of a distance (spacing angle) between one of the first electrodes 16 to be selectively connected by the first connection piece 21 and one of the second electrodes 17 to be selectively connected by the second connection piece 22, the reception frequency of the antenna 14 is set at a predetermined frequency value such as 1575.42 MHz, as shown in FIG. 4.

That is, in this antenna device, in a case where the outer shapes of the case main body 13 and the antenna 14 are small and the inner diameter of the antenna 14 is small, a distance (spacing angle) between one of the first electrodes 16 to be selectively connected by the first connection piece 21 and one of the second electrodes 17 to be selectively connected by the second connection piece 22 is extended, whereby the reception frequency of the antenna 14 is set at a predetermined frequency value such as 1575.42 MHz, as shown in FIG. 4.

Also, in this antenna device, in a case where the outer shapes of the case main body 13 and the antenna 14 are large and the inner diameter of the antenna 14 is large, a distance (spacing angle) between one of the first electrodes 16 to be selectively connected by the first connection piece 21 and one of the second electrodes 17 to be selectively connected by the second connection piece 22 is shortened, whereby the reception frequency of the antenna 14 is set at a predetermined frequency value such as 1575.42 MHz, as shown in FIG. 4.

Next, the mechanism of this wristwatch is described. In the assembly of this wristwatch, first, the first connection piece 21 is attached to one of the plurality of first attachment sections 18 provided on the inner circumference surface of the case main body 13, and the second connection piece 22 is attached to one of the plurality of second attachment sections 19 provided on the inner circumference surface of the case main body 13.

That is, in accordance with the sizes of the outer shapes of the case main body 13 and the antenna 14, or in other words, the size of the inner diameter of the antenna 14, one of the plurality of first attachment sections 18 is selected, and the first connection piece 21 is attached to the selected first attachment section 18. In addition, one of the plurality of second attachment sections 19 is selected, and the second connection piece 22 is attached to the selected second attachment section 19.

For example, in the case where the outer shape of the antenna 14 is small and the inner diameter of the antenna 14 is small, the first connection piece 21 is attached to a first attachment section 18 which is farthest from the reference line extending in the 6 o'clock direction from the center of the circuit board 10 corresponding to the center of the antenna 14 and located at a position corresponding to a spacing angle of 50 degrees with respect to the reference line, and the second connection piece 22 is attached to a second attachment section 19 which is farthest from the reference line and located at a position corresponding to a spacing angle of 50 degrees with respect to the reference line, as shown in FIG. 6.

When the first connection piece 21 is to be attached to the first attachment section 18, the main body section 23*a* of the fixing section 23 of the first connection piece 21 is inserted into the slit hole 18*a* of the first attachment section 18 together with the second plate spring section 24*b*, and the pair of hook sections 23*b* of the fixing section 23 is held in the pair of locking holes 18*b* of the first attachment section 18. As a result, the first connection piece 21 is attached to the first attachment section 18 and fixed to the case main body 13 with the second plate spring section 24*b* protruding below the first attachment section 18.

Similarly, When the second connection piece 22 is to be attached to the second attachment section 19, the main body section 23*a* of the fixing section 23 of the second connection piece 22 is inserted into the slit hole 19*a* of the second attachment section 18 together with the second plate spring section 24*b*, and the pair of hook sections 23*b* of the fixing section 23 is held in the pair of locking holes 19*b* of the second attachment section 19. As a result, the second connection piece 22 is attached to the second attachment section 19 and fixed to the case main body 13 with the second plate spring section 24*b* protruding below the second attachment section 19.

In this state, the timepiece module 7 is mounted in the case main body 13. As a result, the second plate spring section 24*b* of the first connection piece 21 resiliently comes in contact with and is electrically connected to one of the plurality of first electrodes 16 on the circuit board 10 on the housing 8 of timepiece module 7, such as a first electrode 16 which is farthest from the reference line extending in the 6 o'clock direction from the center of the circuit board 10 corresponding to the center of the antenna 14 and located at a position corresponding to a spacing angle of 50 degrees with respect to the reference line.

At the same time, the second plate spring section 24*b* of the second connection piece 22 resiliently comes in contact with and is electrically connected to one of the plurality of second electrodes 17 on the circuit board 10, such as a second electrode 17 which is farthest from the reference line extending in the 6 o'clock direction from the center of the circuit board 10 corresponding to the center of the antenna 14 and located at a position corresponding to a spacing angle of 50 degrees with respect to the reference line.

Next, the antenna 14 is arranged on the case main body 13 via the waterproof ring 13*a*. Here, the watch glass 2 and the glass packing 2*a* are mounted in advance in the inner area of the antenna 14, and the dial plate unit 12 is arranged under the watch glass 2. In this state, when the antenna 14 is arranged on the case main body 13, the first plate spring section 24*a* of the first connection piece 21 resiliently comes in contact with and is electrically connected to the antenna 14. At the same time, the first plate spring section 24*a* of the second connection piece 22 resiliently comes in contact with and is electrically connected to the antenna 14.

Then, the exterior member 15 is mounted on the outer circumferences of the antenna 14 and the case main body 13. In this state, a plurality of screws 14*a* are inserted into a plurality of screw insertion holes (not shown) in the exterior member 15 and a plurality of screw insertion holes 14*b* in the antenna 14. These inserted screws 14*a* are screwed into a plurality of screws holes 13*b* in the case main body 13 and tighten in the case main body 13.

As a result, the antenna 14 and the exterior member 15 are attached to the case main body 13, whereby the assembly of the wristwatch case 1 is completed. Then, when the battery 9 is housed in the housing 8 of the timepiece module 7, and the rear cover 3 is attached to the undersurface of the case main body 13 together with the waterproof packing 3*a*, the assembly of the wristwatch is completed.

In the wristwatch assembled as described above, the first connection piece 21 has been attached to a selected one of the plurality of first attachment sections 18, such as the first attachment section 18 of FIG. 6 which is farthest from the reference line extending in the 6 o'clock direction from the center of the circuit board 10 corresponding to the center of the antenna 14 and located at the position corresponding to a spacing angle of 50 degrees with respect to the reference line, in accordance with the sizes of the outer shapes of the case main body 13 and the antenna 14, that is, the size of the inner diameter of the antenna 14.

Similarly, the second connection piece 22 has been attached to a selected one of the plurality of second attachment sections 19, such as the second attachment section 19 of FIG. 6 which is farthest from the reference line extending in the 6 o'clock direction from the center of the circuit board 10 corresponding to the center of the antenna 14 and located at the position corresponding to a spacing angle of 50 degrees with respect to the reference line.

Accordingly, the second plate spring section 24*b* of the first connection piece 21 is in resilient contact with one of the plurality of first electrodes 16 on the circuit board 10 which corresponds to the selected first attachment section 18, such as the first electrode 16 which is farthest from the reference line extending in the 6 o'clock direction from the center of the circuit board 10 corresponding to the center of the antenna 14 and located at the position corresponding to a spacing angle of 50 degrees with respect to the reference line, and the selected first electrode 16 that is a ground electrode and the antenna 14 have been electrically connected by this first connection piece 21.

Similarly, the second plate spring section 24*b* of the second connection piece 22 is in resilient contact with one of the plurality of second electrodes 17 on the circuit board 10 which corresponds to the selected second attachment section 19, such as the second electrode 17 which is farthest from the reference line extending in the 6 o'clock direction from the center of the circuit board 10 corresponding to the center of the antenna 14 and located at the position corresponding to a spacing angle of 50 degrees with respect to the reference line, and the selected second electrode 17 that is a feeding electrode and the antenna 14 have been electrically connected by this second connection piece 22.

As a result of this structure, the reception frequency of the antenna 14 is specified in accordance with the size of the outer shape of the antenna 14, that is, the size of the inner diameter of the antenna 14. Accordingly, radio waves having a predetermined frequency, such as radio waves of 1575.42 MHz, can be accurately and favorably received by the antenna 14.

That is, in the case where the outer shape of the antenna 14 is small and the inner diameter of the antenna 14 is small, a distance between the first connection piece 21 which is selectively attached to one of the plurality of first attachment sections 18 provided on the case main body 13 and the second connection piece 22 which is selectively attached to one of the plurality of second attachment sections 19 is extended, or in the words, a spacing angle of the first connection piece 21 and a spacing angle of the second connection piece 22 with respect to the reference line extending in the 6 o'clock direction from the center of the circuit board 10 corresponding to the center of the antenna 14 are enlarged.

That is, the first connection piece 21 is attached to, among the plurality of first attachment sections 18, a first attachment sections 18 located farther from the reference line extending in the 6 o'clock direction from the center of the circuit board 10 corresponding to the center of the antenna 14. Also, the second connection piece 22 is attached to, among the plurality of second attachment sections 19, a second attachment section 19 located farther from the reference line extending in the 6 o'clock direction from the center of the circuit board 10 corresponding to the center of the antenna 14. As a result, the distance (spacing angle) between the first connection piece 21 and the second connection piece 22 is extended.

When a distance (spacing angle) between a first electrode 16 to be selectively connected by the first connection piece 21 and a second electrode 17 to be selectively connected by the second connection piece 22 is extended by the above-described operation, the reception frequency of the antenna 14 is increased. Accordingly, although the outer shape of the antenna 14 is small and the inner diameter of the antenna 14 is small, the reception frequency of the antenna 14 is set at a predetermined frequency value, such as 1575.42 MHz. As a result, radio waves having the predetermined frequency can be accurately received by the antenna 14.

Also, as the outer shape of the antenna 14 and the inner diameter of the antenna 14 become larger, a distance (spacing angle) between the first connection piece 21 which is selectively attached to one of the plurality of first attachment sections 18 provided on the case main body 13 and the second connection piece 22 which is selectively attached to one of the plurality of second attachment sections 19 is shortened in stages by 10 degrees at a time.

That is, the first connection piece 21 is attached to the plurality of first attachment sections 18 one by one in order of distance to the reference line extending in the 6 o'clock direction from the center of the circuit board 10 corresponding to the center of the antenna 14. Also, the second connection piece 22 is attached to the plurality of second attachment sections 19 one by one in order of distance to the reference line extending in the 6 o'clock direction from the center of the circuit board 10 corresponding to the center of the antenna 14. As a result, the distance (spacing angle) between the first connection piece 21 and the second connection piece 22 is shortened in stages by 10 degrees at a time.

By the above-described operation, when a distance (spacing angle) between a first electrode 16 to be selectively connected by the first connection piece 21 and a second electrode 17 to be selectively connected by the second connection piece 22 is shortened in stages by 10 degrees at a time, the reception frequency of the antenna 14 is decreased in stages. Accordingly, although the outer shape of the antenna 14 is large and the inner diameter of the antenna 14 is large, the reception frequency of the antenna 14 is adjusted in stages and set at a predetermined frequency value, such as 1575.42 MHz. As a result, radio waves having the predetermined frequency can be accurately received by the antenna 14.

That is, in this antenna device, a distance between a first electrode 16 with which the first connection piece 21 resiliently comes in contact and a second electrode 17 with which the second connection piece 22 resiliently comes in contact, that is, a spacing angle of the first electrode 16 and a spacing angle of the second electrode 17 with respect to the reference line extending in the 6 o'clock direction from the center of the circuit board 10 corresponding to the center of the antenna 14 can be adjusted in stages by 10 degrees at a time, by the selection of the attachment position of the first connection piece 21 with respect to the plurality of first attachment sections 18 of the connection section 25 and the attachment position of the second connection piece 22 with respect to the plurality of second attachment sections 19.

As a result of this structure, the reception frequency of the antenna 14 can be set at a predetermined frequency value such as 1575.42 MHz in accordance with the size of the outer shape of the antenna 14, that is, the size of the inner diameter of the antenna 14. Accordingly, without any design change in accordance with the size of the antenna 14, radio waves having a predetermined frequency can be accurately and favorably received by the antenna 14 by the selection of the attachment position of the first connection piece 21 with respect to the plurality of first attachment sections 18 of the connection section 25 and the attachment position of the second connection piece 22 with respect to the plurality of second attachment sections 19.

As described above, this wristwatch includes the metal antenna 14 which receives radio waves, the circuit board 10 where the plurality of first electrodes 16 and the plurality of second electrodes 17 have been arranged on the circumference of the circle centering on the center of the antenna 14, and the connection section 25 structured such that one of the plurality of first electrodes 16 is selectively connected to the antenna 14 and one of the plurality of second electrodes 17 is selectively connected to the antenna 14, whereby the reception performance of the antenna 14 can be easily secured without any design change being made in accordance with the size of the antenna 14.

That is, in this wristwatch, one of the plurality of first electrodes 16 is selectively connected to the antenna 14 by the connection section 25, and one of the plurality of second electrodes 17 is selectively connected to the antenna 14 by the connection section 25. As a result of this structure, a distance between a first electrode 16 to be connected to the antenna 14 and a second electrode 17 to be connected to the antenna 14 can be changed, whereby the reception frequency of the antenna 14 can be adjusted in accordance with the size of the antenna 14.

Accordingly, in this wristwatch, since the reception frequency of the antenna 14 can be adjusted by a distance between a first electrode 16 to be connected to the antenna 14 and a second electrode 17 to be connected to the antenna 14 being changed by the selection of a first electrode 16 to be connected to the antenna 14 by the connection section 25 and the selection of a second electrode 17 to be connected to the antenna 14 by the connection section 25, design changes in accordance with the size of the antenna 14 are not required, and the reception performance of the antenna 14 can be easily secured. As a result, in this wristwatch, various design changes of the case body 13, the antenna 14, and the exterior member 15 can be easily made.

In this wristwatch where the reception frequency of the antenna 14 is changed in accordance with a distance between a first electrode 16 and a second electrode 17 selected by use of the connection section 25, even when the size of the antenna 14 is changed, the reception frequency of the antenna 14 can be set at a predetermined frequency value such as 1575.42 MHz by changing a distance between a first electrode 16 and a second electrode 17 to be selected by use of the connection section 25, whereby radio waves having the predetermined frequency can be favorably received by the antenna 14.

Also, in this wristwatch, since the reception frequency of the antenna 14 can be adjusted by a distance between a first electrode 16 and a second electrode 17 which are selected by use of the connection section 25 being changed in accordance with the size of the antenna 14, the reception frequency of the antenna 14 can be set at a predetermined frequency value such as 1575.42 MHz, in both cases where the size of the antenna 14 is large or small.

Here, in this wristwatch, since the connection section 25 includes the plurality of first attachment sections 18 corresponding to the plurality of the first electrodes 16, the first connection piece 21 which is selectively attached to one of the plurality of first attachment sections 18 and connects the corresponding first electrode 16 with the antenna 14, the plurality of second attachment sections 19 corresponding to the plurality of the second electrodes 17, and the second connection piece 22 which is selectively attached to one of the plurality of second attachment sections 19 and connects the corresponding second electrode 17 with the antenna 14, one of the plurality of first electrodes 16 can be selected by the first connection piece 21 and one of the plurality of second electrodes 17 can be selected by the second connection piece 22.

Accordingly, in this wristwatch, although the plurality of first electrodes 16 is arranged, the first connection piece 21 attached to one of the plurality of first attachment sections 18 can be connected to one of the plurality of first electrodes 16. Also, although the plurality of second electrodes 17 is arranged, the second connection piece 22 attached to one of the plurality of second attachment sections 19 can be connected to one of the plurality of second electrodes 17.

That is, within the range corresponding to an angle of 0 to 50 degrees, the six first electrodes 16 are arranged at intervals each having a central angle of 10 degrees, toward the 8 o'clock side from the reference line extending in the 6 o'clock direction from the center of the circuit board 10 corresponding to the center of the antenna 14. As a result, one of the six first electrodes 16 can be selected and connected by the first connection piece 21 attached to one of the plurality of first attachment sections 18.

Also, within the range corresponding to an angle of 0 to 30 degrees, the four second electrodes 17 are arranged at intervals each having a central angle of 10 degrees, toward the 4 o'clock side from the point that is distant by the length corresponding to a central angle of 0 to 20 degrees from the reference line extending in the 6 o'clock direction from the center of the circuit board 10. As a result, one of the four second electrodes 17 can be selected and connected by the second connection piece 22 attached to one of the plurality of second attachment sections 19.

As a result of this structure, in this wristwatch, the reception frequency of the antenna 14 can be set in accordance with a distance between a first electrode 16 selectively connected by the first connection piece 21 and a second electrode 17 selectively connected by the second connection piece 22, that is, a spacing angle between the first electrode 16 selected by the first connection piece 21 and the second electrode 17 selected by the second connection piece 22 on the circumference of the circle centering on the center of the antenna 14.

Accordingly, in this wristwatch, a distance between a first electrode 16 selectively connected by the first connection piece 21 and a second electrode 17 selectively connected by the second connection piece 22, that is, a spacing angle between the first electrode 16 and the second electrode 17 on the circumference of the circle centering on the center of the antenna 14 can be adjusted in accordance with the size of the antenna 14, whereby the reception frequency of the antenna 14 can be set at a predetermined frequency value.

That is, in this wristwatch, when the outer shape of the antenna 14 is small and the inner diameter of the antenna 14 is small, a distance (spacing angle) between the first connection piece 21 which is selectively attached to one of the plurality of first attachment sections 18 provided on the case main body 13 and the second connection piece 22 which is selectively attached to one of the plurality of second attachment sections 19 is extended.

That is, by the first connection piece 21 being attached to one of the plurality of first attachment sections 18 which is distant from the reference line extending in the 6 o'clock direction from the center of the circuit board 10 corresponding to the center of the antenna 14, and the second connection piece 22 being attached to one of the plurality of second attachment sections 19 which is distant from the reference line extending in the 6 o'clock direction from the center of the circuit board 10 corresponding to the center of the antenna 14, a distance between the first connection piece 21 and the second connection piece 22, that is, a spacing angle between the corresponding first electrode 16 and the corresponding second electrode 17 on the circumference of the circle centering on the center of the antenna 14 can be extended.

When a distance (spacing angle) between a first electrode 16 to be selectively connected by the first connection piece 21 and a second electrode 17 to be selectively connected by the second connection piece 22 is extended as described above, the reception frequency of the antenna 14 is increased. Accordingly, even when the outer shape of the antenna 14 is small and the inner diameter of the antenna 14 is small, the reception frequency of the antenna 14 can be set at a predetermined frequency value such as 1575.42 MHz, so that radio waves having the predetermined frequency can be accurately and favorably received by the antenna 14.

Also, in this wristwatch, when the outer shape of the antenna 14 is large and the inner diameter of the antenna 14 is large, a distance (spacing angle) between the first connection piece 21 which is selectively attached to one of the plurality of first attachment sections 18 provided on the case main body 13 and the second connection piece 22 which is selectively attached to one of the plurality of second attachment sections 19 is shortened.

That is, by the first connection piece 21 being attached to one of the plurality of first attachment sections 18 which is close to the reference line extending in the 6 o'clock direction from the center of the circuit board 10 corresponding to the center of the antenna 14, and the second connection piece 22 being attached to one of the plurality of second attachment sections 19 which is close to the reference line extending in the 6 o'clock direction from the center of the circuit board 10 corresponding to the center of the antenna 14, a distance between the first connection piece 21 and the second connection piece 22, that is, a spacing angle between the corresponding first electrode 16 and the corresponding second electrode 17 on the circumference of the circle centering on the center of the antenna 14 can be decreased.

When a distance (spacing angle) between a first electrode 16 to be selectively connected by the first connection piece 21 and a second electrode 17 to be selectively connected by the second connection piece 22 is shortened as described above, the reception frequency of the antenna 14 is decreased. Accordingly, even when the outer shape of the antenna 14 is large and the inner diameter of the antenna 14 is large, the reception frequency of the antenna 14 can be set at a predetermined frequency value such as 1575.42 MHz, so that radio waves having the predetermined frequency can be accurately and favorably received by the antenna 14.

Accordingly, in this antenna device, a distance between a first electrode 16 with which the first connection piece 21 resiliently comes in contact and a second electrode 17 with which the second connection piece 22 resiliently comes in contact, that is, a spacing angle between the first electrode 16 and the second electrode 17 on the circumference of the circle centering on the center of the antenna 14 can be adjusted by the selection of the attachment position of the first connection piece 21 with respect to the plurality of first attachment sections 18 and the attachment position of the second connection piece 22 with respect to the plurality of second attachment sections 19.

As a result of this structure, in this antenna device, the reception frequency of the antenna 14 can be set at a predetermined frequency value such as 1575.42 MHz in accordance with the size of the outer shape of the antenna 14, that is, the size of the inner diameter of the antenna 14. Accordingly, no design change is necessary when the size of the antenna 14 is changed by a model change, and radio waves having a predetermined frequency can be accurately and favorably received by the antenna 14. Therefore, a variety of design changes can be easily achieved.

Also, the wristwatch includes the case main body 13 which is made of synthetic resin and to which the antenna 14 is attached, and the plurality of first attachment sections 18 and the plurality of second attachment sections 19 are provided on this case main body 13. As a result of this structure, the plurality of first attachment sections 18 and the plurality of second attachment sections 19 can be provided on the case main body 13 without extra parts, which reduces the number of parts and improves the assembling work.

Also, in this wristwatch, each of the first and second connection pieces 21 and 22 includes the fixing section 23 which is fixed to one of the plurality of first attachment sections 18 or one of the plurality of attachment section 19, the first plate spring section 24*a* which resiliently comes in contact with the antenna 14, and the second plate spring section 24*b* which resiliently comes in contact with one of the plurality of first electrodes 16 or one of the plurality of second electrodes 17. As a result, by the first and second connection pieces 21 and 22, the antenna 14 and one of the plurality of first electrodes 16 or one of the plurality of second electrodes 17 can be unfailingly and favorably connected to each other.

Also, each fixing section 23 includes the main body section 23*a* which is inserted into the slit hole 18*a* of one of the first attachment sections 18 or the slit hole 19*a* of one of the second attachment sections 19, and the pair of hook sections 23*b* which is held in the pair of locking holes 18*b* provided to the sides of the slit hole 18*a* of each first attachment section 18 or the pair of locking holes 19*b* provided to the sides of the slit hole 19*a* of each second attachment section 19. As a result, by the fixing sections 23, the first connection piece 21 and the second connection pieces 22 can be unfailingly and favorably fixed to one of the plurality of first attachment sections 18 and one of the plurality of second attachment sections 19, respectively.

That is, by the main body section 23*a* of the fixing section 23 being inserted into the slit hole 18*a* of one of the first attachment sections 18 together with the second plate spring section 24*b*, and the pair of hook sections 23*b* of the fixing section 23 being held in the pair of locking holes 18*b* of the first attachment section 18, the first connection piece 21 can be unfailingly attached to the first attachment section 18 with the second plate spring section 24*b* protruding below the first attachment section 18.

As a result, the first plate spring section 24*a* of the first connection piece 21 can be unfailingly brought into resilient contact with the antenna 14 and the second plate spring section 24*b* of the first connection piece 21 can be unfailingly brought into resilient contact with one of the plurality of first electrodes 16. As a result of this structure, by the first connection piece 21, the antenna 14 and one of the plurality of first electrodes 16 can be unfailingly and favorably connected to each other.

Also, by the main body section 23*a* of the fixing section 23 being inserted into the slit hole 19*a* of one of the second attachment sections 19 together with the second plate spring section 24*b*, and the pair of hook sections 23*b* of the fixing section 23 being held in the pair of locking holes 19*b* of the second attachment section 19, the second connection piece 22 can be unfailingly attached to the second attachment section 19 with the second plate spring section 24*b* protruding below the second attachment section 19.

As a result, the first plate spring section 24*a* of the second connection piece 22 can be unfailingly brought into resilient contact with the antenna 14 and the second plate spring section 24*b* of the second connection piece 22 can be unfailingly brought into resilient contact with one of the plurality of second electrodes 17. As a result of this structure, by the second connection piece 22, the antenna 14 and one of the plurality of second electrodes 17 can be unfailingly and favorably connected to each other.

Also, in this wristwatch, although the magnetic sensor 20 is provided on the circuit board 10, its position is located opposing the plurality of first electrodes 16 and the plurality of second electrodes 17. That is, its position is located on the 12 o'clock side which is farthest from the plurality of first electrodes 16 and the plurality of second electrodes 17. As a result, effects of the plurality of first electrodes 16 and the plurality of second electrodes 17 on the magnetic sensor 20 can be diminished, so that the accuracy and performance of the magnetic sensor 20 can be maintained and the magnetic sensor 20 can make a stable measurement. In addition, the plurality of first electrodes 16 and the plurality of second electrodes 17 are not affected by the magnetic sensor 20, so that radio waves can be accurately and favorably received by the antenna 14.

In the above-described embodiment, the six first electrodes 16 and the four second electrodes 17 are arranged on the circumference of the circle centering on the center of the circuit board 10 corresponding to the center of the antenna 14. However, the present invention is not limited thereto, and a structure may be adopted in which four to eight first electrodes 16 and two to six second electrodes 17 are arranged. Also, a structure may be adopted in which one first electrode 16 and a plurality of second electrodes 17 are arranged, or a plurality of first electrodes 16 and one second electrode 17 are arranged.

Also, in the above-described embodiment, the present invention has been applied in a wristwatch. However, the present invention is not necessarily required to be applied in a wristwatch. For example, the present invention is applicable to various types of timepieces such as a travel watch, an alarm clock, a table clock and a wall clock. Moreover, the present invention is not necessarily required to be applied in timepieces, and can be widely applied in electronic devices having a wireless communication function, such as a portable telephone.

While the present invention has been described with reference to the preferred embodiments, it is intended that the invention be not limited by any of the details of the description therein but includes all the embodiments which fall within the scope of the appended claims.

What is claimed is:

1. An antenna device comprising:

an antenna which is made of metal and receives radio wave;

a substrate;

a plurality of first electrodes and at least one second electrode provided on the substrate, wherein the plurality of first electrodes and the at least one second electrode are positioned on a circumference of a circle centering on a center of the antenna, wherein the plurality of first electrodes and the at least one second electrode are circumferentially spaced from one another on the substrate, and wherein the plurality of first electrodes comprises a connection target first electrode and the at least one second electrode comprises a connection target second electrode; and a connection section which connects the connection target first electrode to the antenna and connects the connection target second electrode to the antenna.

2. The antenna device according to claim 1, wherein a reception frequency of the antenna is changed in accordance with a distance between the connection target first electrode and the connection target second electrode.

3. The antenna device according to claim 2, wherein the reception frequency of the antenna is adjusted by the distance between the connection target first electrode and the connection target second electrode being changed in accordance with a size of the antenna.

4. The antenna device according to claim 3, wherein the connection section comprises:

a plurality of first attachment sections corresponding to the plurality of first electrodes;

a first connection piece which is selectively attached to one of the plurality of first attachment sections and connects the connection target first electrode and the antenna;

wherein the at least one second electrode comprises a plurality of second electrodes;

a plurality of second attachment sections corresponding to the plurality of second electrodes; and a second connection piece which is selectively attached to one of the plurality of second attachment sections and connects the connection target second electrode and the antenna.

5. The antenna device according to claim 4, further comprising:

a case main body which is made of synthetic resin and to which the antenna is attached, wherein the case body is provided with the plurality of first attachment sections and the plurality of second attachment sections.

6. The antenna device according to claim 4, wherein each of the first connection piece and the second connection piece comprises:

a fixing section which is fixed to one of the plurality of first attachment sections or one of the plurality of second attachment sections;

a first spring section which resiliently comes in contact with the antenna; and a second spring section which resiliently comes in contact with one of the connection target first electrode and the connection target second electrode.

7. The antenna device according to claim 2, wherein the connection section comprises:

a plurality of first attachment sections corresponding to the plurality of first electrodes;

a first connection piece which is selectively attached to one of the plurality of first attachment sections and connects the connection target first electrode and the antenna;

wherein the at least one second electrode comprises a plurality of second electrodes;

a plurality of second attachment sections corresponding to the plurality of second electrodes; and a second connection piece which is selectively attached to one of the plurality of second attachment sections and connects the connection target second electrode and the antenna.

8. The antenna device according to claim 7, further comprising:

a case main body which is made of synthetic resin and to which the antenna is attached, wherein the case body is provided with the plurality of first attachment sections and the plurality of second attachment sections.

9. The antenna device according to claim 7, wherein each of the first connection piece and the second connection piece comprises:

a fixing section which is fixed to one of the plurality of first attachment sections or one of the plurality of second attachment sections;

a first spring section which resiliently comes in contact with the antenna; and a second spring section which resiliently comes in contact with one of the connection target first electrode and the connection target second electrode.

10. The antenna device according to claim 2, wherein the substrate has a magnetic sensor provided at a position opposing the plurality of first electrodes and the at least one second electrode.

11. The antenna device according to claim 1, wherein a reception frequency of the antenna is adjusted by a distance between the connection target first electrode and the connection target second electrode being changed in accordance with a size of the antenna.

12. The antenna device according to claim 11, wherein the connection section comprises:

a plurality of first attachment sections corresponding to the plurality of first electrodes;

a first connection piece which is selectively attached to one of the plurality of first attachment sections and connects the connection target first electrode and the antenna;

wherein the at least one second electrode comprises a plurality of second electrodes;

a plurality of second attachment sections corresponding to the plurality of second electrodes; and a second connection piece which is selectively attached to one of the plurality of second attachment sections and connects the connection target second electrode and the antenna.

13. The antenna device according to claim 12, further comprising:

a case main body which is made of synthetic resin and to which the antenna is attached, wherein the case body is provided with the plurality of first attachment sections and the plurality of second attachment sections.

14. The antenna device according to claim 12, wherein each of the first connection piece and the second connection piece comprises:

a fixing section which is fixed to one of the plurality of first attachment sections or one of the plurality of second attachment sections;

a first spring section which resiliently comes in contact with the antenna; and a second spring section which resiliently comes in contact with one of the connection target first electrode and the connection target second electrode.

15. The antenna device according to claim 1, wherein the connection section comprises:

a plurality of first attachment sections corresponding to the plurality of first electrodes;

a first connection piece which is selectively attached to one of the plurality of first attachment sections and connects the connection target first electrode and the antenna;

wherein the at least one second electrode comprises a plurality of second electrodes;

a plurality of second attachment sections corresponding to the plurality of second electrodes; and a second connection piece which is selectively attached to one of the plurality of second attachment sections and connects the connection target second electrode and the antenna.

16. The antenna device according to claim 15, further comprising:

a case main body which is made of synthetic resin and to which the antenna is attached, wherein the case body is provided with the plurality of first attachment sections and the plurality of second attachment sections.

17. The antenna device according to claim 16, wherein each of the first connection piece and the second connection piece comprises:

a fixing section which is fixed to one of the plurality of first attachment sections or one of the plurality of second attachment sections;

a first spring section which resiliently comes in contact with the antenna; and a second spring section which resiliently comes in contact with one of the connection target first electrode and the connection target second electrode.

18. The antenna device according to claim 15, wherein each of the first connection piece and the second connection piece comprises:

a fixing section which is fixed to one of the plurality of first attachment sections or one of the plurality of second attachment sections;

a first spring section which resiliently comes in contact with the antenna; and a second spring section which resiliently comes in contact with one of the connection target first electrode and the connection target second electrode.

19. The antenna device according to claim 1, wherein the substrate has a magnetic sensor provided at a position opposing the plurality of first electrodes and the at least one second electrode.

20. A timepiece comprising the antenna device according to claim 1.

* * * * *